US006879304B2

(12) United States Patent
Campbell

(10) Patent No.: US 6,879,304 B2
(45) Date of Patent: Apr. 12, 2005

(54) ROW AND/OR COLUMN DECODER OPTIMIZATION METHOD AND APPARATUS

(75) Inventor: John G. Campbell, Los Altos, CA (US)

(73) Assignee: Aurora Systems, Inc., San Jose, CA (US)

( * ) Notice: Subject to any disclaimer, the term of this patent is extended or adjusted under 35 U.S.C. 154(b) by 516 days.

(21) Appl. No.: 09/894,119

(22) Filed: Jun. 27, 2001

(65) Prior Publication Data

US 2001/0038363 A1 Nov. 8, 2001

Related U.S. Application Data

(62) Division of application No. 09/075,447, filed on May 8, 1998, now Pat. No. 6,275,202.

(51) Int. Cl.[7] ..... G09G 3/20
(52) U.S. Cl. ..... 345/55
(58) Field of Search ..... 345/55, 76, 92, 345/98, 99, 100; 365/185.12, 185.2, 185.25, 185.29, 230.06

(56) References Cited

U.S. PATENT DOCUMENTS 5,801,672 A 9/1998 Masuda et al. ..... 345/98
5,844,535 A 12/1998 Itoh et al. ..... 345/92

OTHER PUBLICATIONS

Texas Instruments, *TTL Advanced Low–Power Schottky, Advanced Schottky Data Book*, vol. 2, (1993) pp 2–85–2–89.

*Primary Examiner*—Vijay Shankar
(74) *Attorney, Agent, or Firm*—Henneman & Saunders; Larry E. Henneman, Jr.

(57) ABSTRACT

A row decoder (10) for a video display system (12) wherein row output lines (28) of a row predecoder (20) are physically arranged such that adjacent iterations of the output lines (28) will generally not be switching simultaneously where addressing of the output lines (28) is sequential according to numbering and application. A ground trace (32) is provided between iterations of the output lines (28) which will be switching simultaneously. The output lines (28) provide input to a decoding circuit (34) within the row decoder (10). A plurality iterations of predecoder subcircuits (21) each having a compliment of the output lines (28) is to provided such that all of the rows of a pixel array (14) can be addressed.

23 Claims, 4 Drawing Sheets

| 40 | 21 Set 1 | | | | | | | | 21 Set 2 | | | | | | | | 42 |
|---|---|---|---|---|---|---|---|---|---|---|---|---|---|---|---|---|---|
| a | 0 | x | 1 | x | 2 | x | 3 | X | 0 | x | 1 | x | 2 | x | 3 | X | 4 |
| b | 0 | x | 1 | | 3 | x | 2 | | 0 | x | 1 | | 3 | x | 2 | | 2 |
| c | 0 | | 2 | x | 1 | | 3 | X | 0 | | 2 | x | 1 | | 3 | X | 2 |
| d | 0 | | 2 | x | 3 | | 1 | | 0 | | 2 | x | 3 | | 1 | | 1 |
| e | 0 | x | 3 | | 1 | x | 2 | | 0 | x | 3 | | 1 | x | 2 | | 2 |
| f | 0 | x | 3 | x | 2 | x | 1 | | 0 | x | 3 | x | 2 | x | 1 | | 3 |
| g | 1 | x | 2 | x | 3 | x | 0 | X | 1 | x | 2 | x | 3 | x | 0 | X | 4 |
| h | 1 | x | 2 | | 0 | x | 3 | X | 1 | x | 2 | | 0 | x | 3 | X | 3 |
| i | 1 | | 3 | x | 0 | | 2 | | 1 | | 3 | x | 0 | | 2 | | 1 |
| j | 1 | | 3 | x | 2 | | 0 | X | 1 | | 3 | x | 2 | | 0 | X | 2 |
| k | 1 | x | 0 | x | 3 | x | 2 | | 1 | x | 0 | x | 3 | x | 2 | | 3 |
| l | 1 | x | 0 | | 2 | x | 3 | X | 1 | x | 0 | | 2 | x | 3 | X | 3 |
| m | 2 | x | 3 | x | 0 | x | 1 | | 2 | x | 3 | x | 0 | x | 1 | | 3 |
| n | 2 | x | 3 | | 1 | x | 0 | X | 2 | x | 3 | | 1 | x | 0 | X | 3 |
| o | 2 | x | 1 | | 3 | x | 0 | X | 2 | x | 1 | | 3 | x | 0 | X | 3 |
| p | 2 | x | 1 | x | 0 | x | 3 | X | 2 | x | 1 | x | 0 | x | 3 | X | 4 |
| q | 2 | | 0 | x | 3 | | 1 | | 2 | | 0 | x | 3 | | 1 | | 1 |
| r | 2 | | 0 | x | 1 | | 3 | X | 2 | | 0 | x | 1 | | 3 | X | 2 |
| s | 3 | x | 2 | x | 1 | x | 0 | X | 3 | x | 2 | x | 1 | x | 0 | X | 4 |
| t | 3 | x | 2 | | 0 | x | 1 | | 3 | x | 2 | | 0 | x | 1 | | 2 |
| u | 3 | | 1 | x | 0 | | 2 | | 3 | | 1 | x | 0 | | 2 | | 1 |
| v | 3 | | 1 | x | 2 | | 0 | X | 3 | | 1 | x | 2 | | 0 | X | 2 |
| w | 3 | x | 0 | | 2 | x | 1 | | 3 | x | 0 | | 2 | x | 1 | | 2 |
| x | 3 | x | 0 | x | 1 | x | 2 | | 3 | x | 0 | x | 1 | x | 2 | | 3 |

32

28 32 28 32

FIG. 4

ROW AND/OR COLUMN DECODER OPTIMIZATION METHOD AND APPARATUS

RELATED APPLICATIONS

This application is a divisional of U.S. patent application Ser. No. 09/075,447, filed on May 8, 1998 now U.S. Pat. No. 6,275,202, by the same inventor, which is incorporated herein by reference in its entirety.

TECHNICAL FIELD

The present invention relates to the field of electronic circuitry, and more particularly to address decoders such as are used for decoding row or column information in a video display device. The predominant current usage of the inventive optimized row decoder is in the decoding of row information in video display devices wherein the ability to rapidly change states is important.

BACKGROUND ART

Row and column decoders are well known in the art for activating rows and columns in array devices. Many array devices are memory arrays, and the technology of row decoders has, in great part, been developed for use with such memory devices. Another type of array device is the array display device. This category includes liquid crystal display ("LCD") devices. In general, a row decoder is used to activate a particular row of the display such that data present on a plurality of column lines will affect the intended row. To date, the row and column decoders used with such video display devices are not substantially different in concept from comparable devices which are used in conjunction with memory array devices.

Another device known in the field is the predecoder. One skilled in the art will recognize that a predecoder will allow a required amount of binary data to be transmitted on fewer data lines than might be required if the data were not to be "predecoded". For example, four different row addresses can be referenced according to the four different logical state combinations of two data lines.

It is known in the art that capacitive interaction between adjoining data lines will substantially detract from the ability of such lines to change state rapidly. Where one line of two adjacent lines is changing state, this is somewhat of a problem. However, where the two adjacent lines are simultaneously attempting to change states in opposite direction (one is going high, while the other is going low), this problem is severely compounded, especially when the adjacent lines are long.

It would be a significant improvement if a method or apparatus were found to decrease the detrimental effect caused by the simultaneous state changes of adjacent data lines within a row or column decoder. This is particularly important given the present quest for increased speed and/or lower power consumption. (In this case, as in many such instances, there is a trade off between speed and power consumption. That is, a decrease in the capacitive interaction between adjacent lines could be used to cause greater operational speed for a given applied power. Alternatively, less power could be used to achieve the same speed, or some combination of improved speed and power consumption could be accomplished.) However, to the inventor's knowledge, no such improvement in the design of row and column decoders has been presented prior to the present invention.

DISCLOSURE OF INVENTION

Accordingly, it is an object of the present invention to provide a row and/or column decoder which will change states faster than comparable prior art decoders.

It is still another object of the present invention to provide a row and/or column decoder which can achieve a desired speed using less power than prior art devices.

It is yet another object of the present invention to provide a method and apparatus for reducing the effect of sideways capacitive coupling in adjacent data lines in particular applications.

It is still another object of the present invention to provide a method and apparatus for improving the performance of row and/or column decoders which does not effectively increase the cost of producing the decoders.

It is yet another object of the present invention to provide a method and apparatus for improving the performance of row and/or column decoders which does not take up a great deal of real estate on an integrated circuit.

Briefly, an embodiment of the present invention is an improved row decoder for a video display device which has row addressing lines configured such that no two adjacent lines will be switching states simultaneously. The invention takes advantage of the fact that the rows of the video display device, unlike rows or columns of memory array devices, will generally be switching sequentially. That is, the rows are addressed in order, for example beginning at the top of a screen and progressing in order to the bottom of the screen. This makes possible the inventive physical layout.

An advantage of the present invention is that video display devices can be caused to operate more quickly.

A further advantage of the present invention is that row and/or column decoders can be operated using less power.

Yet another advantage of the present invention is that it can be readily implemented into existing row and/or column decoder designs without extensive modification.

These and other objects and advantages of the present invention will become clear to those skilled in the art in view of the description of the described mode of carrying out the invention and the industrial applicability of the embodiment as described herein and as illustrated in the several figures of the drawing.

BRIEF DESCRIPTION OF THE DRAWINGS

FIG. 4 is a table showing some possible variations in the arrangement of data lines according to the present inventive method and apparatus.

DETAILED DESCRIPTION OF THE INVENTION

Figure 1:
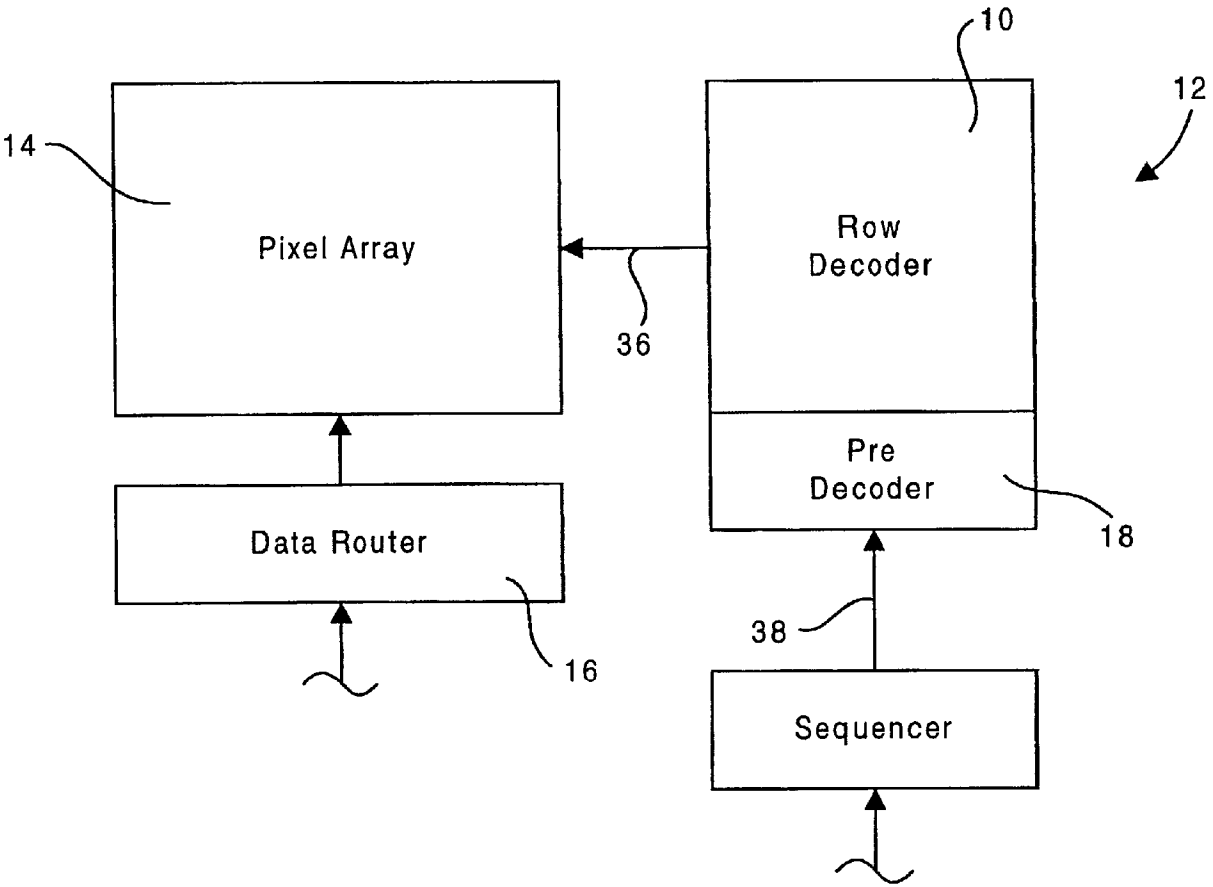
FIG. 1 is a block schematic diagram of a portion of a video display system including the present inventive improved row decoder.

The invention is embodied in an improved row decoder 10, which is depicted in box schematic form in the view of FIG. 1, for use in a video display system 12 such as is used for displaying a computer video output or other video image such as a television picture. One skilled in the art will recognize that the video display system 12, such as might employ the present inventive improved row decoder 10, will have many components which are conventional and well known in the art. In part, the video display system 12 will have, in addition to the improved row decoder 10, a pixel array 14, a data router 16, a row sequencer 38 and, in the embodiment depicted in FIG. 1, a row predecoder 18.

In the video display system 12 of FIG. 1, the data router 16 routes data to columns of the pixel array 14. The data router 16 is described in detail in a copending patent application Ser. No. 08/970,443, which is incorporated by reference herein. It should be noted, however, that the present invention is not dependant upon any particular method or apparatus for supplying data to the columns of the pixel array 14. The row decoder 10 enables rows of the pixel array 14 such that data provided through the data router 16 will affect the particular row of the pixel array 14 which is intended.

Figure 2:
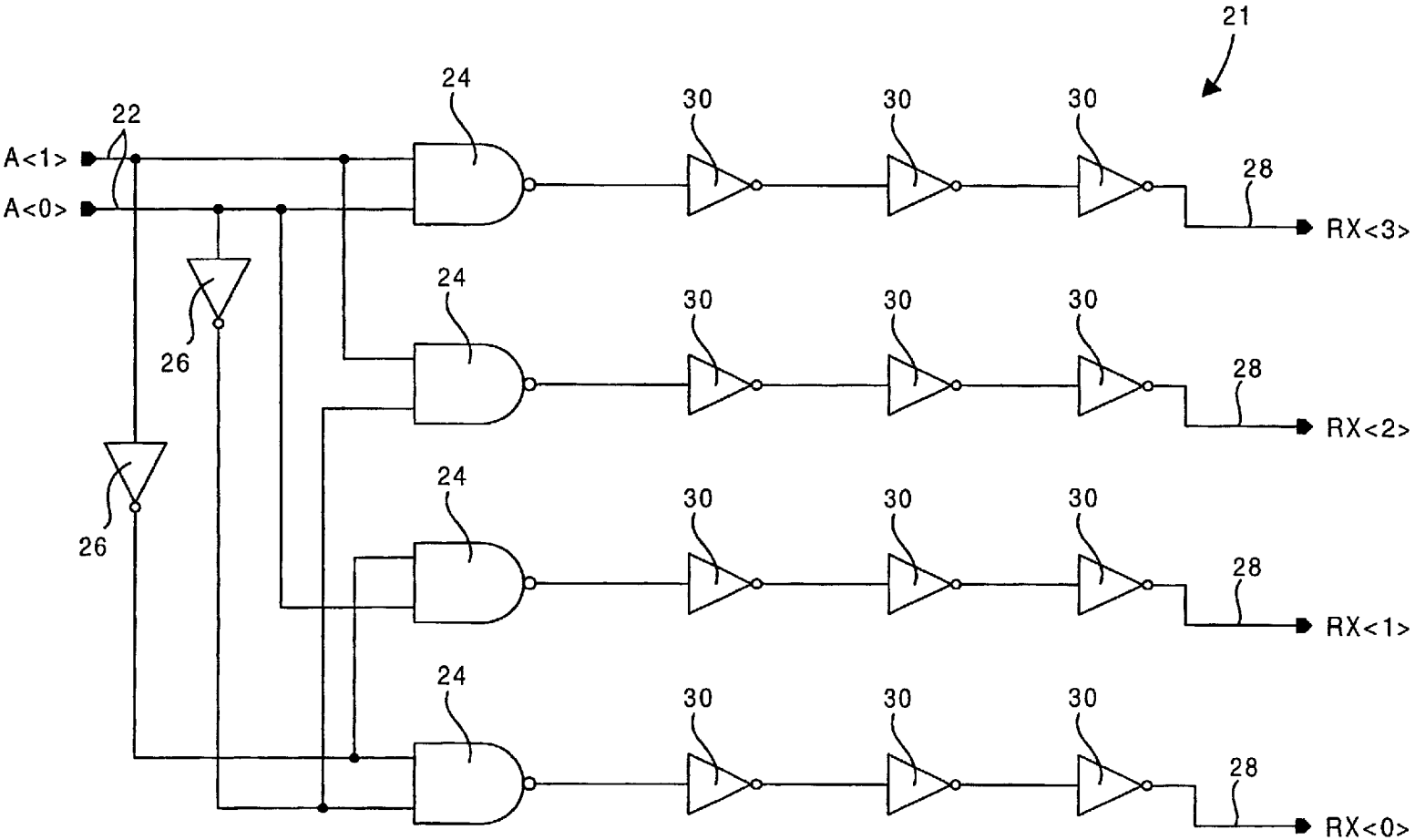
FIG. 2 is a schematic diagram of a predecoder subcircuit as used in the video display system of FIG. 1.

FIG. 2 is a schematic diagram of a predecoder subcircuit 21 which will form a portion of the predecoder 18 of FIG. 1, as will be discussed in greater detail hereinafter. In the view of FIG. 2, it can be seen that two input data lines 22 provide data to four nand gates 24. In this embodiment two inverters 26 invert the state of the data lines 22. One skilled in the art will recognize that another common method, not shown, would be to separately provide inverted inputs such that inversion within the predecoder 20 would not be required. Either configuration could be employed in conjunction with the present inventive row decoder 10.

Although it is not necessary to the practice of the invention, in the embodiment shown, each of four output lines 28 has three output inverters 30 for increasing the gain of the signal on the output lines 28 and, since an odd number of the output inverters 30 is employed on each output line 28, for inverting the output of the nand gates 24. One skilled in the art will recognize that one of the four output lines 28 will be high, depending upon which of the four logical combinations of binary states in which the two input data lines 22 exist. Specifically, in the embodiment depicted, the output lines (at the points designated by "RX" in the view of FIG. 2) will be as follows: When both inputs A<0> and A<1> are low, then RX<0> will be high; when A<0> is high and A<1> is low, then RX<1> will be high; when A<0> is low and A<1> is high, then RX<2> will be high; and when both inputs A<0> and A<1> are high, then RX<3> will be high.

It should be noted that, in the actual embodiment of the video display system 12 of FIG. 1, the pixel array 14 is anticipated to be 1024 columns by 768 rows in size. Whatever the quantity of rows in a particular application, the quantity of iterations of the circuit shown in the view of FIG. 2 should be provided which is sufficient to address all of the rows of the intended pixel array 14. In the example of 768 rows, five iterations of the predecoder subcircuit (21) will be employed to provide the ten data bits necessary to address the 768 rows.

Figure 3:
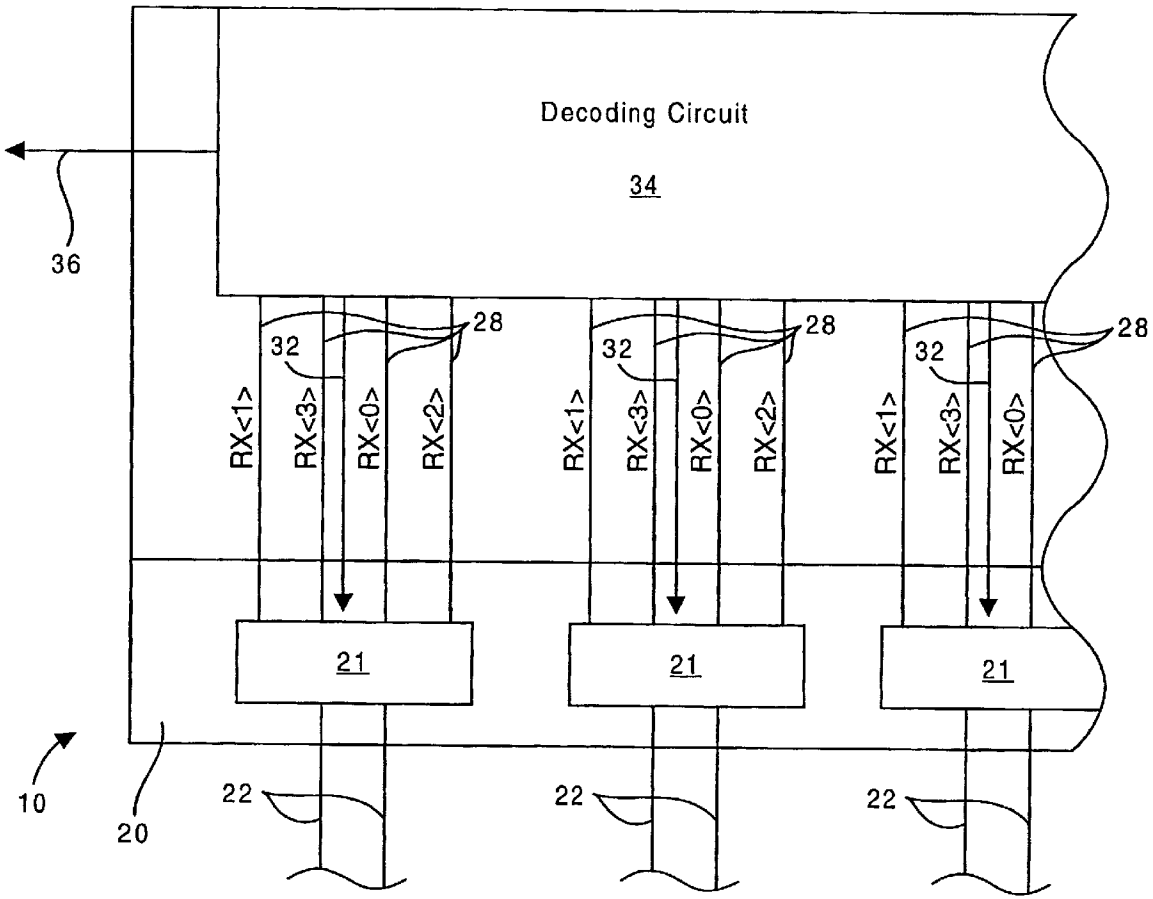
FIG. 3 is a block schematic diagram of a portion of a row decoder and predecoder assembly according to the present invention.

FIG. 3 is a block schematic diagram showing an example of a portion of the row predecoder 20 and the improved row decoder 10 of FIG. 1. One skilled in the art of integrated circuit design will recognize that the electrical schematic of the predecoder subcircuit 21 depicted in FIG. 2 is an electrical schematic only, and does not dictate how the components thereof are to be laid out in a circuit chip. According to the described example of the present invention, the several iterations of the predecoder subcircuit 21 utilized will be laid out such that the output lines 28 are positioned, as depicted in the view of FIG. 3, in the following sequence: RX<1>, RX<3>, RX<0>, RX<2>. (That is, were the output lines 28 to be designated as A, B, C, D, respectively according to the order in which they are switched high, then the physical layout would be sequentially: B, D, A, C. Between each RX<3> and the adjacent RX<0> is a ground trace 32.

It should be noted that results similar (but not equal to) some of the advantages of the present invention might be achieved by simply placing iterations of the ground traces 32 between each and all of the output lines 28 and also between each set thereof. However, this would not be practical for reasons including that it would require additional real estate on the chip, and additional expense.

A decoding circuit 34 of the row decoder 10 is a conventional decoder circuit such as is found in the prior art and is not affected by the present invention except that the decoding circuit 34 may operate faster as described herein. The decoding circuit 34 contains the logic to take as input the plurality (in the case of the present example, five) sets of four output lines 28 from the predecoder subcircuits 21 and enable a particular row of the pixel array 14 as intended. It should be noted that, in the view of FIG. 1, a single decoder output 36 is shown to represent the plurality (one per row) of outputs from the decoder circuitry 34 (FIG. 3) to the pixel array 14. Similarly, in the view of FIG. 1, a single predecoder input 38 is used to represent the input data lines 22 of FIG. 3. Other data routes which are not specifically discussed in relation to FIG. 1 are also represented by a single line even though one skilled in the art will recognize that these are generally busses which will have therein a plurality of data paths.

In light of the above description, it will be recognized that where only one of the four output lines 28 of each predecoder subcircuit 21 is to be high at any given time, then it will be likely according to prior art arrangements that adjacent output lines 28 will be switching simultaneously. That is, were output lines designated as A, B, C and D to be laid out and switched in that order, then after B is high, then C would be going high while B would simultaneously be going back low. However, according to the present inventive apparatus and method, the inventor has discovered that no two adjacent output lines 28 will be changing state simultaneously (with the exceptions such as those discussed hereinafter in relation to FIG. 4. which will have a ground trace 32 therebetween.) This depends upon the condition, which is typical in the described application, that switching of the output lines 28 will be sequential (that is, sequential according to the numbering and usage, but not sequential according to the present inventive layout). In prior art memory array applications, or in any application wherein switching of the output lines 28 is random rather than sequential, the present invention would not provide the intended benefit.

FIG. 4 is a table depicting the logical sequences of arrangements of the four output lines 28 for sequential sets of the predecoder subcircuits 21 where each of the predecoder subciruits has the output lines 28 arranged in like order. This is by no means an exclusive list of the scope of the invention since variations such as having different sets of output lines 28 arranged in different orders are quite likely useful. Also, the present invention is in no way restricted to applications wherein the quantities are as described in relation to the examples herein. As just one example, in some applications it is likely that quantities of output lines 28 per row predecoder other than four are possible.

In the table of FIG. 4, the rows 40 (enumerated as "a" through "x", inclusive) represent the various possible physical arrangement of the output lines 28 which will switch in the order "0,1, 2, and then 3". A right hand column 42 of the table of FIG. 4 indicates the quantity of ground traces 32 per set (equivalent to all of the outputs of one of the predecoder subcircuits 21) that will be required due to the fact that adjacent output lines 28 will be switched consecutively (and will, therefore, be switching simultaneously). In the table of FIG. 4, the ground traces are represented by an "x" within the table. Note that the upper case "X" indicates a ground trace 32 between the sets 21. This is merely an effort to make the table of FIG. 4 more readily understandable. In practice, there is not significant difference between ground traces 32 between the output lines 28 within a set 21 and ground traces 32 between the sets.

In the table of FIG. 4 it can be seen that the sequences designated by rows 40(*d*), (*i*), (*q*) and (*u*) are optimal in the sense that these require the fewest quantity of ground traces. The example of row 40(*i*) is that which has previously been discussed herein in relation to FIG. 3.

It should be noted that, between adjacent sets 21, it is possible to have some arrangements wherein adjacent output lines would be switching in the same direction simultaneously. This would produce a reinforcing effect which could actually cause the output lines 28 to switch faster than might otherwise be the case. The inventors have found that this is also generally an undesirable condition, since it might interfere with the overall timing and stability of the circuit and, therefore, ground traces 32 should generally also be placed between sets 21 where this condition would otherwise occur.

One skilled in the art will recognize that the present invention is applicable to any decoder or subdecoder for decoding sequential values, and is not limited to the decoding of display addresses.

As previously mentioned herein, the present invention can be applied equally to column decoders as well as row decoders, were the column decoders to be addressed in a sequential or other ordered pattern. Indeed, in some applications the terms "row" and "column" have less meaning than in the typical video display array application, and such terms may be used interchangeably.

While the invention as described herein is embodied as a portion of an integrated circuit, the invention could also be applied to other physical embodiments. Indeed, if there were to be an application wherein the sort of switching lines falling within the scope of the invention were to be laid out on a printed circuit board, then the advantages described herein could be attained.

The inventor has discovered that the present inventive method and apparatus will result in less than one third the cross coupling between adjacent output lines 28 as compared to prior art instances wherein adjacent output lines 28 are switching in opposite directions simultaneously.

Various modifications may be made to the invention without altering its value or scope. As just one example, the actual predecoder circuitry depicted by way of the example of FIG. 2 is not necessary to the practice of the present invention, and any conceivable arrangement for providing the groups of output lines 28 which can be physically arranged according to the present inventive method might be employed for the purpose.

Yet another example of a potential variation of the invention would be in an application wherein sequential switching of lines other than those intended for addressing the rows or columns of an array is intended. Although the inventor does not have in mind any such specific application, it is anticipated that the invention could be effectively applied thereto were such an application to arise.

All of the above are only some of the examples of available embodiments of the present invention. Those skilled in the art will readily observe that numerous other modifications and alterations may be made without departing form the spirit and scope of the invention. Accordingly, the above disclosure is not intended as limiting and the appended claims are to be interpreted as encompassing the entire scope of the invention.

I claim:

1. A method for decreasing capacitive cross coupling in sequentially addressed data lines, comprising:

providing a plurality of input lines for receiving data;

providing said data lines in subset groupings as traces of a decoder;

providing decoder logic operative to enable one of said data lines depending on said data received on said input lines, and responsive to a sequential stream of data being asserted on said input lines said decoder logic is operative to enable said data lines in consecutive order; and ordering each of said subset groupings out of consecutive order such that at least one of said data lines in each of said subset groupings is not physically adjacent to any of said data lines in same subset groupings which will switch generally simultaneously therewith.

2. The method of claim 1, and further including:

providing a ground trace between any of said data lines and any adjacent of said data lines which will switch generally simultaneously therewith.

3. The method of claim 1, and further including:

providing a ground trace between each of said subset groupings.

4. The method of claim 1, wherein:

the quantity of data lines in each of said subset groupings is four.

5. The method of claim 1, wherein:

said sequentially addressed data lines are row enable lines in a video pixel array.

6. The method of claim 1, wherein:

the step of ordering each of said subset groupings includes physically arranging the traces in an order B, D, A, C where the sequential order of switching is A, B, C, D.

7. The method of claim 1, wherein:

the step of ordering each of said subset groupings includes physically arranging the traces in an order A, C, D, B where the sequential order of switching is A, B, C, D.

8. The method of claim 1, wherein:

the step of ordering each of said subset groupings includes physically arranging the traces in an order C, A, D, B where the sequential order of switching is A, B, C, D.

9. The method of claim 1, wherein:

the step of ordering each of said subset groupings includes physically arranging the traces in an order D, B, A, C where the sequential order of switching is A, B, C, D.

10. The method of claim 1, wherein:

said traces are the physical traces of an integrated circuit chip.

11. The method of claim 1, wherein said decoder is a predecoder and said method further comprises providing enable signals to additional decoder logic with said data lines.

12. The method of claim 11, wherein:

the predecoder accepts two inputs to cause one of four of said traces to go high, depending upon the combination of states of the two inputs.

13. The method of claim 1, wherein:

the quantity of traces is sufficient to address all rows of the pixel array.

14. The method of claim 1, wherein:

the step of providing said data lines in subset groupings includes grouping the total quantity of traces in sets of four.

15. The method of claim 14, and further including:

providing a plurality of ground traces physically placed such that one of said ground traces is between each of the sets of four traces.

16. The method of claim 15, wherein:

the data lines and the ground traces are each traces on an integrated circuit.

17. A method of claim 1, wherein said step of providing data lines in subset groupings as traces of a decoder includes providing said data lines in subset groupings of four as traces of a predecoder, said data lines enabled sequentially in the order A, B, C, D, said method further comprising:

coupling said data lines of said predecoder to input lines of additional decoder logic such that the data lines may be designated as A line, B line, C line and D line, respectively; and positioning of one of said A line and said D line between said B line and C line.

18. The method of claim 1, further comprising:

coupling the decoder to enable rows of a pixel array.

19. A method for decreasing capacitive cross coupling in sequentially addressed data lines, comprising:

providing said data lines in subset groupings as traces of a decoder; and ordering each of said subset groupings such that at least one of said data lines in each of said subset groupings is not physically adjacent to any of said data lines in same subset groupings which will switch generally simultaneously therewith; and wherein the step of ordering each of said subset groupings includes physically arranging the traces in an order B, D, A, C where the sequential order of switching is A, B, C, D.

20. A method for decreasing capacitive cross coupling in sequentially addressed data lines, comprising:

providing said data lines in subset groupings as traces of a decoder; and ordering each of said subset groupings such that at least one of said data lines in each of said subset groupings is not physically adjacent to any of said data lines in same subset groupings which will switch generally simultaneously therewith; and wherein the step of ordering each of said subset groupings includes physically arranging the traces in an order A, C, D, B where the sequential order of switching is A, B, C, D.

21. A method for decreasing capacitive cross coupling in sequentially addressed data lines, comprising:

providing said data lines in subset groupings as traces of a decoder; and ordering each of said subset groupings such that at least one of said data lines in each of said subset groupings is not physically adjacent to any of said data lines in same subset groupings which will switch generally simultaneously therewith; and wherein the step of ordering each of said subset groupings includes physically arranging the traces in an order C, A, D, B where the sequential order of switching is A, B, C, D.

22. A method for decreasing capacitive cross coupling in sequentially addressed data lines, comprising:

providing said data lines in subset groupings as traces of a decoder; and ordering each of said subset groupings such that at least one of said data lines in each of said subset groupings is not physically adjacent to any of said data lines in same subset groupings which will switch generally simultaneously therewith; and wherein the step of ordering each of said subset groupings includes physically arranging the traces in an order D, B, A, C where the sequential order of switching is A, B, C, D.

23. A method for decreasing capacitive cross coupling in sequentially addressed data lines, comprising:

providing said data lines in subset groupings, as traces of a decoder;

ordering each of said subset groupings such that at least one of said data lines in each of said subset groupings is not physically adjacent to any of said data lines in same subset groupings which will switch generally simultaneously therewith;

providing a predecoder having four outputs which are enabled sequentially in the order A, B, C, D, coupling said outputs of said predecoder to the data lines of one of said subset groupings such that the data lines may be designated as A line, B line, C line and D line, respectively; and positioning one of said A line and said D line between said B line and said C line.

* * * * *